US006711760B1

(12) United States Patent
Yang

(10) Patent No.: US 6,711,760 B1
(45) Date of Patent: Mar. 30, 2004

(54) SELF-LOCK HUB UNIT OF LOWER FRAME OF A FOLDABLE PLAYYARD

(75) Inventor: Kai-Ming Yang, Taipei (TW)

(73) Assignee: Mission Hills Investment Corporation, George Town (KY)

( * ) Notice: Subject to any disclaimer, the term of this patent is extended or adjusted under 35 U.S.C. 154(b) by 0 days.

(21) Appl. No.: 10/320,156

(22) Filed: Dec. 16, 2002

(51) Int. Cl.[7] ..... A47D 7/00
(52) U.S. Cl. ..... 5/99.1; 5/93.1; 16/324
(58) Field of Search ..... 5/99.1, 98.1, 93.1; 16/324, 325, 326

(56) References Cited

U.S. PATENT DOCUMENTS

| | | | | | |
|---|---|---|---|---|---|
| 2,574,079 | A | * | 11/1951 | White | 5/99.1 |
| 4,739,527 | A | * | 4/1988 | Kohus et al. | 5/99.1 |
| 5,279,006 | A | * | 1/1994 | Teng | 5/99.1 |
| 5,664,267 | A | * | 9/1997 | Cheng | 5/99.1 |
| 5,890,263 | A | * | 4/1999 | Wu | 16/324 |
| 6,256,814 | B1 | * | 7/2001 | Drobinski | 5/99.1 |
| 6,305,037 | B1 | | 10/2001 | Cheng | 5/99.1 |
| 6,317,907 | B1 | * | 11/2001 | Wang | 5/99.1 |
| 6,336,234 | B1 | * | 1/2002 | Kuo | 5/99.1 |
| 6,510,569 | B1 | * | 1/2003 | Hu | 5/99.1 |
| 6,615,424 | B1 | * | 9/2003 | Cheng | 5/99.1 |
| 2002/0184705 | A1 | * | 12/2002 | Cheng | 5/99.1 |
| 2003/0061657 | A1 | * | 4/2003 | Longenecker et al. | 5/99.1 |

* cited by examiner

*Primary Examiner*—Robert G. Santos

(74) *Attorney, Agent, or Firm*—Gauthier & Connors LLP

(57) ABSTRACT

The present application provides a self-lock hub unit of the lower frame of the playyard includes a body (10) having a plurality of slots formed at a periphery thereof for receiving tube legs of the playyard and a vertical cavity formed at the center thereof; an actuating member (20) which is vertically movably received in the cavity; two sliding engaging assemblies (30) movably mounted two oppositely positioned tube legs respectively, each sliding engaging assembly having a first member, a second member coupled to the first member for movably coupling the first member to one of the tube legs, and a biasing member disposed in the tube leg to bias the first and second members toward an open end of the tube leg, wherein the two oppositely positioned tube legs are rotatably received in two radially opposite slots of the body respectively; two locking means (16, 17) formed on the body at positions corresponding to the sliding engaging assemblies respectively and having a guiding portion (18, 18') and an engaging portion (19, 19'); and a strap (40) coupled to the actuating member, wherein the actuating member, the sliding engaging assemblies, and locking means are arranged such that while the tube legs are rotated from vertical position to horizontal position, the second member of the sliding engaging assembly will contact with and guided by the guiding portion of the locking means to engage with the engaging portion of the locking means and thereby locking the tube legs in horizontal position with at least one portion of the first member of the sliding engaging assembly protruding into the central cavity; and while the actuating member is moved upward by pulling the strap, the actuating member will engage with the at least one portion of the first member that protruding into the cavity and push the first member to cause the second member disengaging with the engaging portion of the locking means.

18 Claims, 9 Drawing Sheets

SELF-LOCK HUB UNIT OF LOWER FRAME OF A FOLDABLE PLAYYARD

FIELD OF THE INVENTION

The present invention relates generally to a foldable playyard and more particularly, to an improved self-lock hub unit of lower frame of a foldable playyard.

BACKGROUND OF THE INVENTION

U.S. Pat. No. 6,305,037 has disclosed a lower frame structure of a foldable playyard, which included a hub assembly. As illustrated in FIG. 11, the hub assembly included a substantially hollow cylindrical body 110, four coupling portions 112*a–d* spaced apart from each other and non-axially extending outwardly from the hub body for receiving hub legs, and locking means rotatably coupled the hub body for operablely cooperating with the coupling portions to lock the hub legs in an erected position, wherein each of the coupling portions comprises a reversed U-shaped cross-section, an elongated slot formed in both side walls thereof, and an opening formed in a top wall thereof.

The locking means included a bias spring 120 disposed in hub body; a latch member 130 rotatably coupled to the hub body and arranged such that it is biased toward a lock position by the bias spring, wherein the latch member has two substantially L-shaped arms formed at two substantially positions of a lower face of a periphery portion thereof and each of the L-shaped arm has a vertical portion and a horizontal portion which will be inserted into the slots of corresponding coupling portion of the hub body as the latch member is biased toward the lock position by the bias spring to lock the hub legs in the erected position; and a knob 140 coupled to the latch member to turn the latch member toward an unlock position such that the horizontal portion of the L-shaped arm withdrawn from the slot and the hub legs may pivot from the erected position to the collapsed position.

Although the hub assembly 10 disclosed in the above-mentioned '037 is able to perform a locking/unlocking function of the lower frame of the playyard, it is inconvenient to perform the unlocking operation because it takes two steps to do it, i.e., first turn the knob and then lift the hub assembly, and thus may cause confusion.

SUMMARY OF THE INVENTION

Accordingly, the object of the present invention is to provide an improved self-lock hub unit of a lower frame of a foldable playyard, of which the locking/unlocking operation may be performed in one step.

To achieve this and other advantages and according to the purpose of the present invention, as embodied and broadly described, the hub unit of the lower frame of the playyard includes a body having a plurality of slots formed at a periphery thereof for receiving tube legs of the playyard and a vertical cavity formed at the center thereof; an actuating member which is vertically movably received in the central cavity; two sliding engaging assemblies movably mounted two oppositely positioned tube legs respectively, each sliding engaging assembly having a first member, a second member coupled to the first member for movably coupling the first member to one of the tube legs, and a biasing member disposed in the tube leg to bias the first and second members toward an open end of the tube leg, wherein the two oppositely positioned tube legs are rotatably received in two radially opposite slots of the body respectively; two locking means formed on the body at positions corresponding to the sliding engaging assemblies respectively and having a guiding portion and an engaging portion; and a strap coupled to the actuating member; wherein the actuating member, the sliding engaging assemblies, and locking means are arranged such that while the tube legs are rotated from vertical position to horizontal position, the second member of the sliding engaging assembly will contact with and guided by the guiding portion of the locking means to engage with the engaging portion of the locking means and thereby locking the tube legs in horizontal position with at least one portion of the first member of the sliding engaging assembly protruding into the central cavity; and while the actuating member is moved upward by pulling the strap, the actuating member will engage with the at least one portion of the first member that protruding into the cavity and push the first member to cause the second member disengaging with the engaging portion of the locking means.

According to another embodiment of the present invention, a self-lock hub unit of a lower frame of a playyard comprises a body having a plurality of slots formed at a periphery thereof for receiving tube legs of the playyard and a rectangular recess formed at the center portion and defined by two opposite long-side walls and two short-side walls; two guiding plates disposed at the central portion of the recess and parallel with the short-side walls, the guiding plates being arranged such that they are spaced apart from each other so as to define a cavity therebetween; an actuating member which is movably received in the cavity; two sliding engaging assemblies movably mounted two oppositely positioned tube legs respectively, each sliding engaging assembly having a first member, a second member coupled to the first member for movably coupling the first member to one of the tube legs, and a biasing member disposed in the tube leg to bias the first and second members toward an open end of the tube leg, wherein the two oppositely positioned tube legs are rotatably received in two radially opposite slots of the body respectively; two locking means formed on the body at positions corresponding to the sliding engaging assemblies respectively and having a guiding portion and an engaging portion; and a strap coupled to the actuating member, wherein the actuating member, the sliding engaging assemblies, and locking means are arranged such that while the tube legs are pivoted from a vertical position to a horizontal position, the second member of the sliding engaging assembly will contact with and guided by the guiding portion of the locking means to engage with the engaging portion of the locking means and thereby locking the tube legs in an erected position; and while the actuating member is moved upward by pulling the strap, the actuating member will push the second member to disengage with the engaging portion of the locking means.

Additional features and advantages of the present invention will be set forth in the description which follows, and in part will be apparent from the description, or may be learned by practice of the invention. The objectives and advantages of the invention will be realized and attained by the structure particularly pointed out in the written description and claims hereof as well as the appended drawings.

BRIEF DESCRIPTION OF THE DRAWINGS

The accompanying drawings, which are included to provide a further understanding of the invention and are incorporated in and constitute a part of the specification, illustrate embodiments of the invention and together with the description serve to explain the principle of the invention. In the drawings.

DETAILED DESCRIPTION OF THE INVENTION

Figure 1:
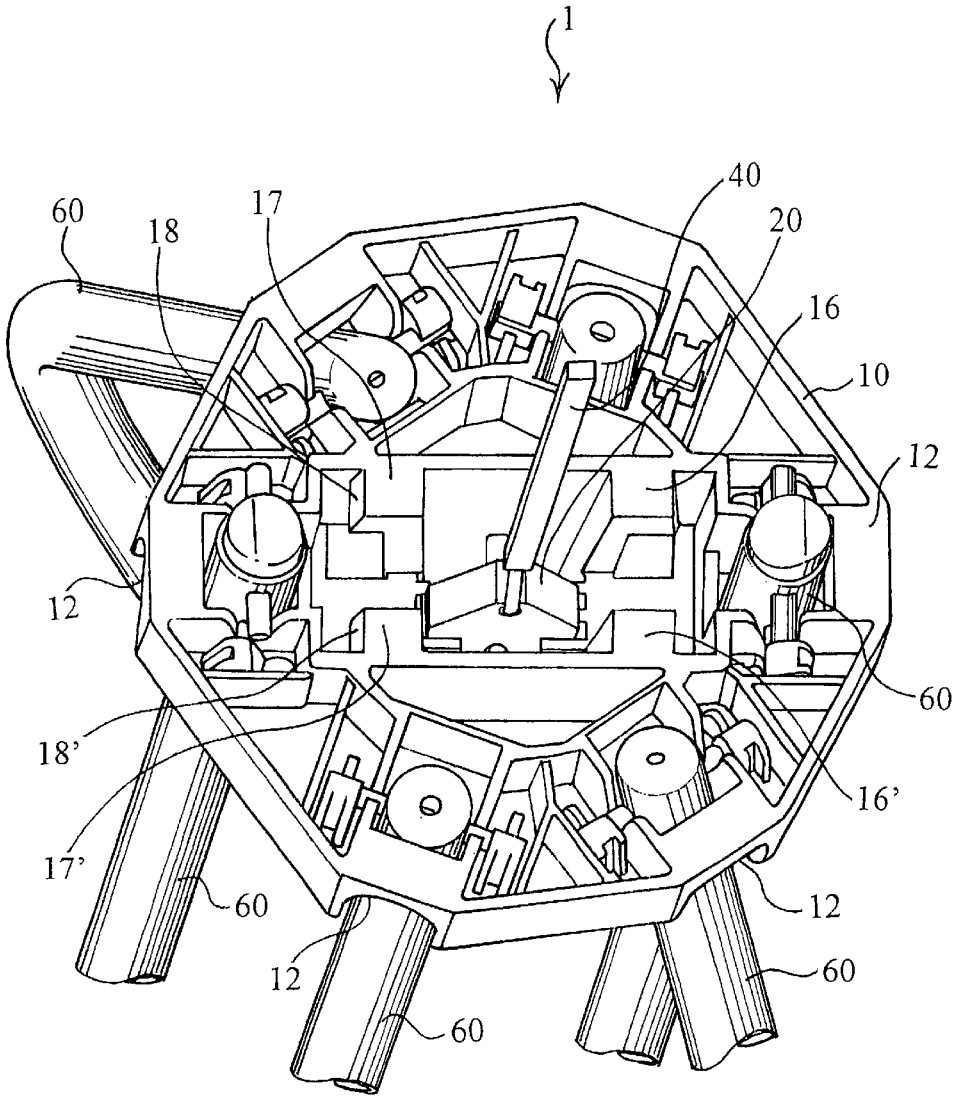
FIG. 1 is a perspective view of a self-lock hub unit according to a first embodiment of the present application.
Figure 2:
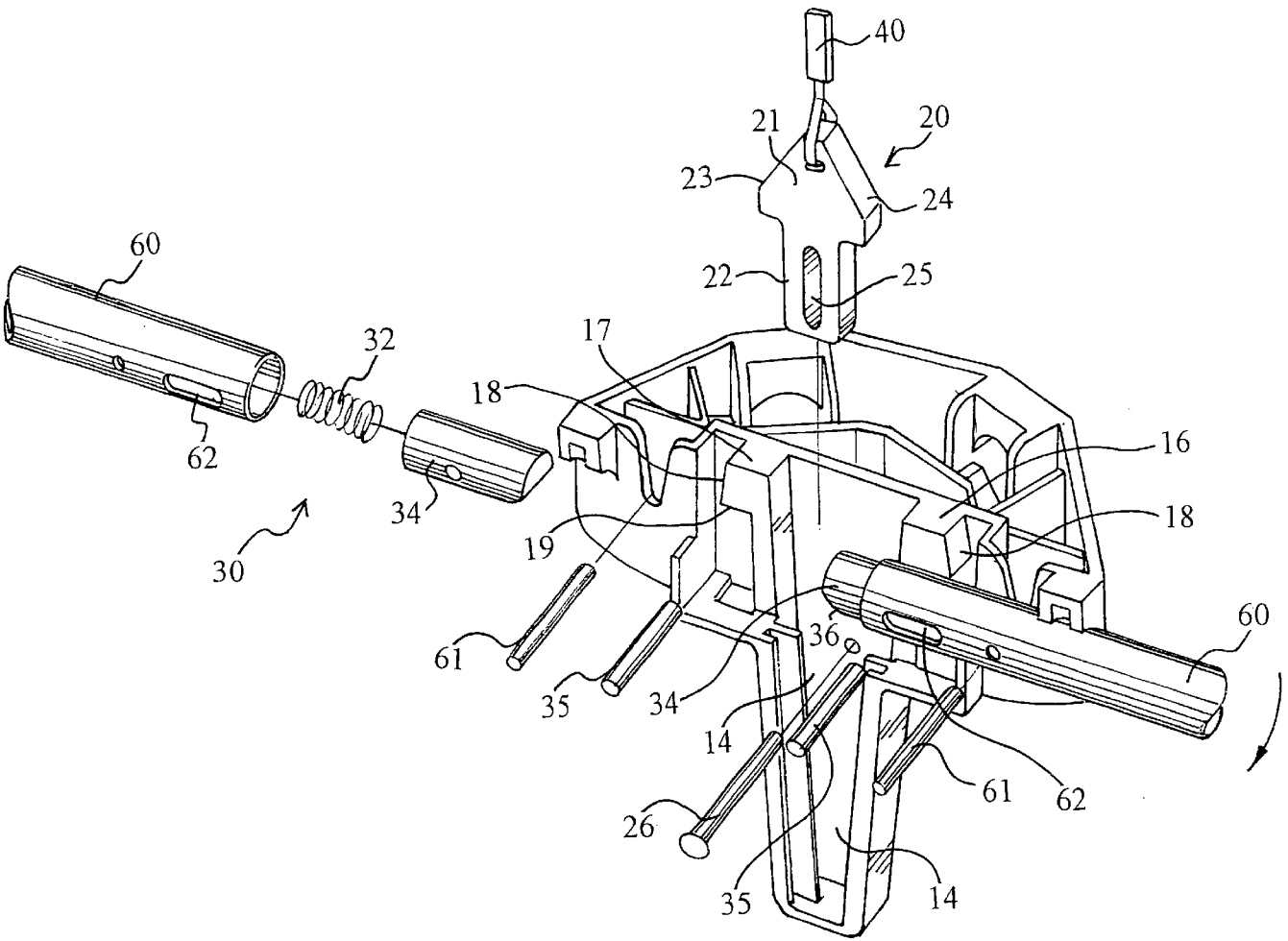
FIG. 2 is a partial sectional, exploded perspective view of the self-lock hub unit according to the first embodiment of the present application.

Referring now to the drawings to explain the present invention in detail. FIGS. 1–4 illustrated a self-lock hub unit according to the first embodiment of the present application. As shown in FIGS. 1 and 2, the self-lock hub unit 1 of a lower frame of a playyard generally comprises a body 10 having a plurality of slots 12 formed at a periphery thereof for receiving tube legs 60 of the playyard and a vertical cavity 14 formed at the center thereof; an actuating member 20 which is vertical movably received in the vertical cavity 14; two sliding engaging assemblies 30 movably mounted to two oppositely positioned tube legs 60 respectively at an open end of the tube legs and the two oppositely positioned tube legs 60 being rotatably received in two radially opposite slots 12 of the body respectively; and a strap 40 coupled to the actuating member 20.

The tube legs 60 are pivotally coupled to the slots 12 of the body 10 through pins 61. Each of the tube legs 60 has two opposite elongated openings 62 formed in a tube wall thereof at positions adjacent to the open end of the tube leg. Each of the sliding engaging assemblies 30 includes a spring 32 disposed in the tube leg 60 through the open end and abutting the pin 61, a slide 34 disposed in the tube leg 60, and a coupling pin 35 extending through the elongated openings 62 and the slide 34 to slidably couple the slide 34 to the tube leg 60 with both ends of the coupling pin 35 extending out over the tube wall a distance. The slide 34 will protrude out the open end of the tube leg 60 a distance because of the biasing fore exerted thereon by the spring 32. The slide 34 is substantially a cylinder with an inwardly slanted surface 36 formed at the end extending out of the tube leg 60.

The body 10 further comprises two locking assemblies formed at positions corresponding to the two oppositely positioned tube legs 60 respectively. Each of the two locking assemblies includes two locking member, i.e., locking members 16, 16' and 17, 17', wherein locking members 16, 17 are disposed at the top of two opposite side walls of the vertical cavity 14 and locking members 16', 17' are disposed at positions opposite to corresponding locking members 16, 17 with a space formed therebetween, as shown in FIG. 1. The space between the locking members 16, 16' and 17, 17' is sized to be larger than an outer diameter of the tube leg 60 to allow the open end of the tube leg 60 and the portion of the slide 34 that protrudes out the tube leg can pass it while the tube leg 60 pivots about the pin 61. Each of the locking members 16, 16', 17, 17' is of a reversed 'L' shape and has a vertical portion and a horizontal portion. The horizontal portion has a bottom face 19 (or 19') and an outwardly inclined face 18 (or 18') formed at a free end thereof. The locking members 16, 16' and 17, 17' are arranged at positions such that when tube leg 60 pivots about the pin and causes the open end of the tube legs 60 together with the portion of the slide 34 that protrudes out the tube leg to pass through the space between the locking members, the portions of the coupling pins 35 that extends out the tube wall will contact the inclined surfaces 18, 18' of the locking members.

The actuating member 20 includes a head portion 21 and a stem portion 22. The head portion 21 includes a left inclined face 23 and a right inclined face 24. Both inclined faces 23, 24 are outwardly and downwardly slanted from the top of the head portion 21 to make the head portion 21 as an arrow shape. Stem portion 22 has an elongated longitudinal opening 25 formed therein. The actuating member 20 is movably received in the vertical cavity 14 of the body 10 and coupled to the body 10 by extending a rivet 26 through the opening 25 and fixing it to cavity walls. Optionally, the actuating member 20 may include a return spring (not shown) which is retained in the opening 25 by fixing one end thereof to the rivet 26 and abutting the other end to the bottom of the opening 25.

Figure 3:
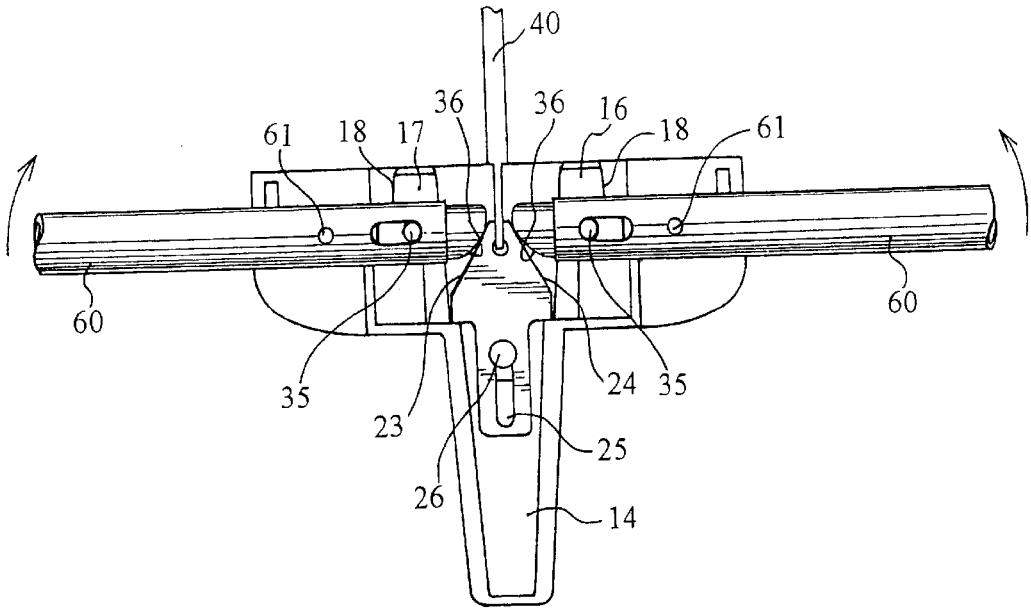
FIG. 3 is a cross-section view of self-lock hub unit according to the first embodiment of the present application, which illustrates the tube legs are in a locked state.
Figure 4:
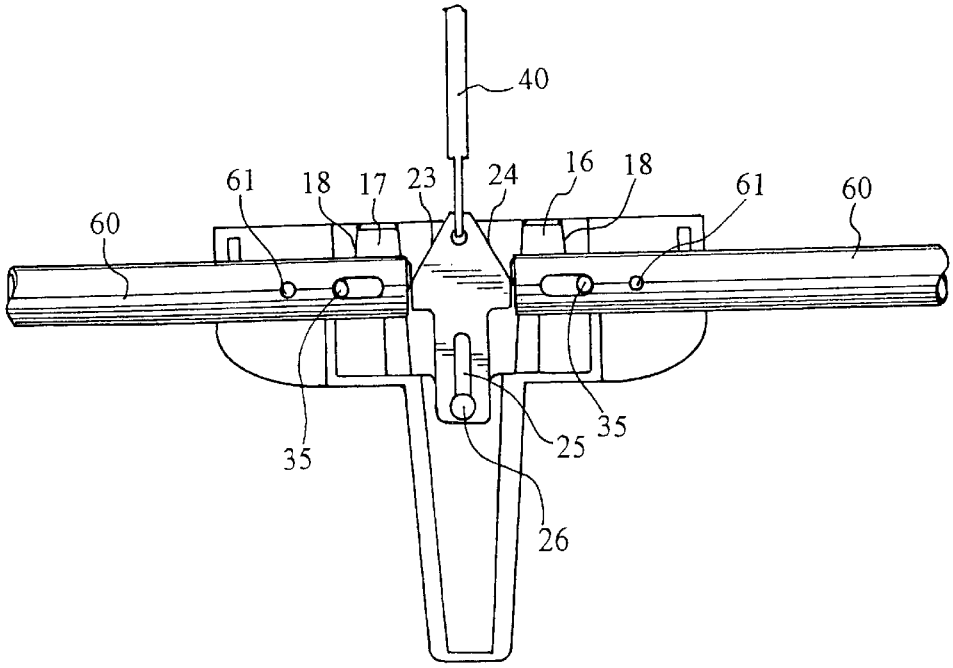
FIG. 4 is a cross-section view of self-lock hub unit according to the first embodiment of the present application, which illustrates the tube legs are in an un-locked state.
Figure 9:
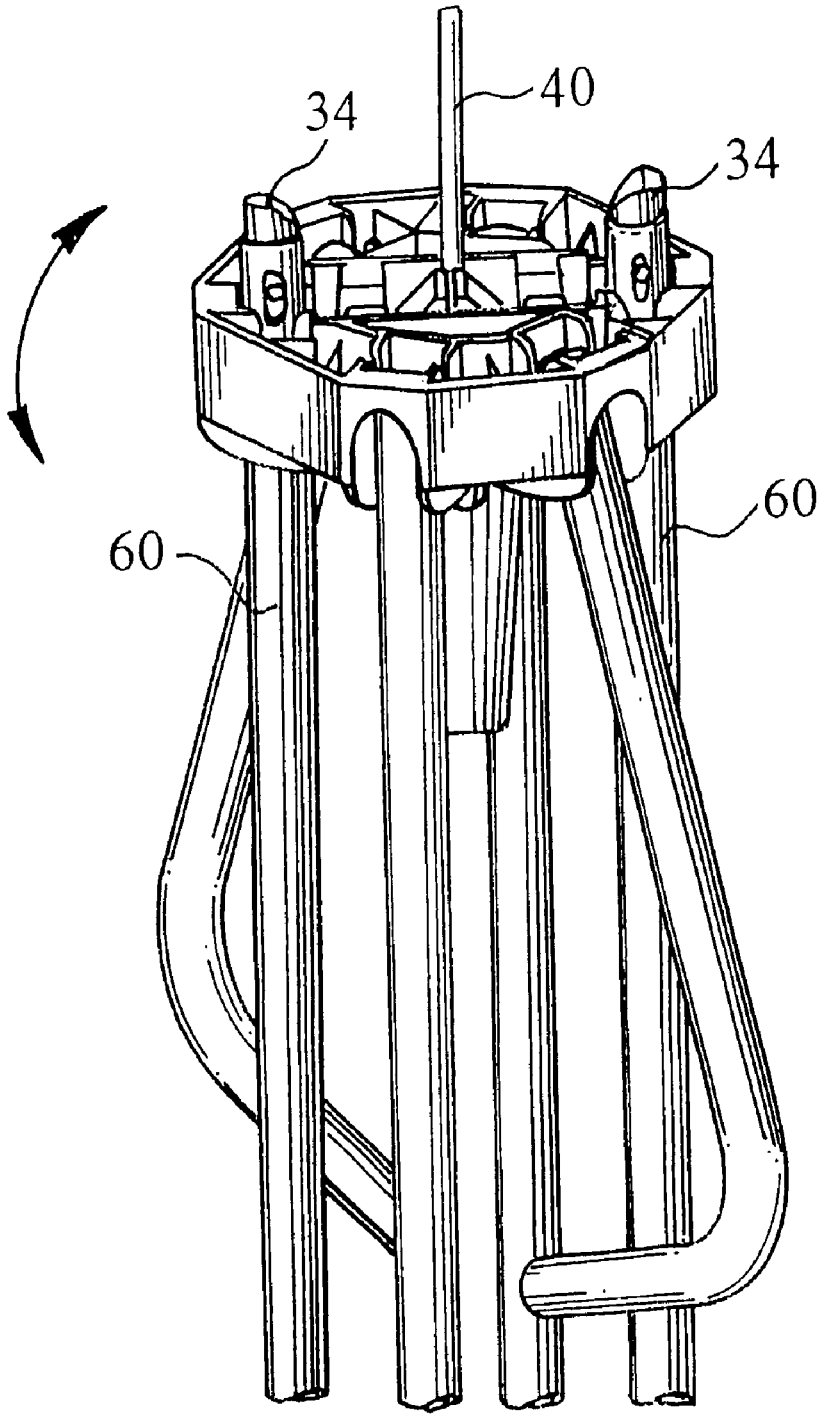
FIG. 9 is a perspective view illustrating tube legs of the playyard are collapsed while the hub unit of the present application is in an un-locked state.
Figure 10:
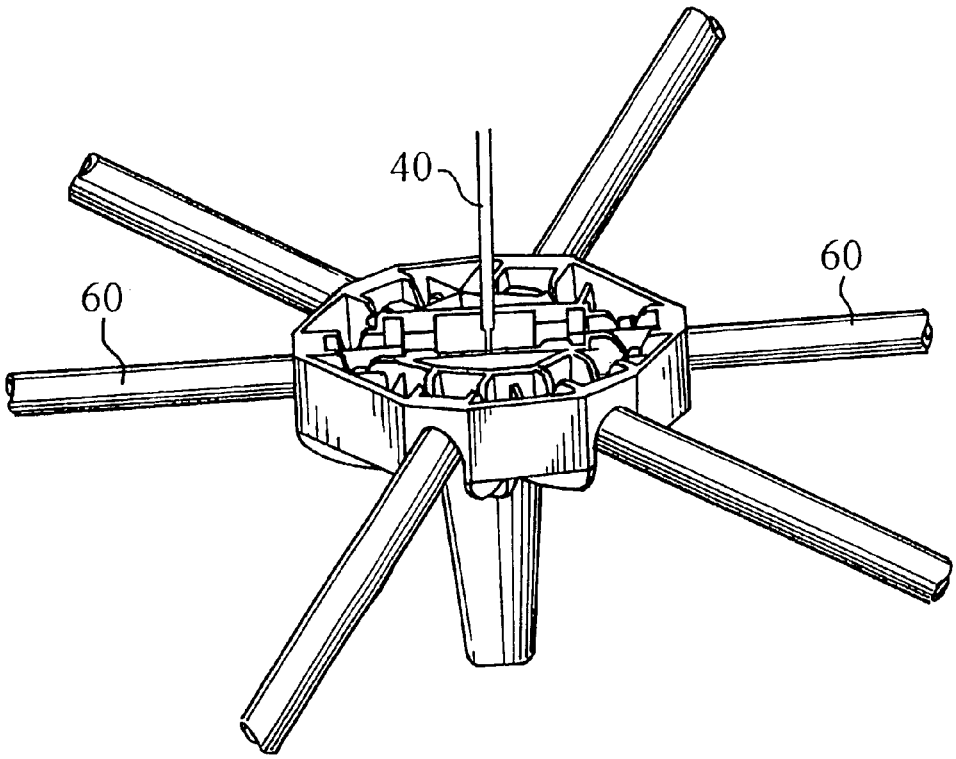
FIG. 10 is a perspective view illustrating tube legs of the playyard are erected while the hub unit of the present application is in a locked state.
Figure 11:
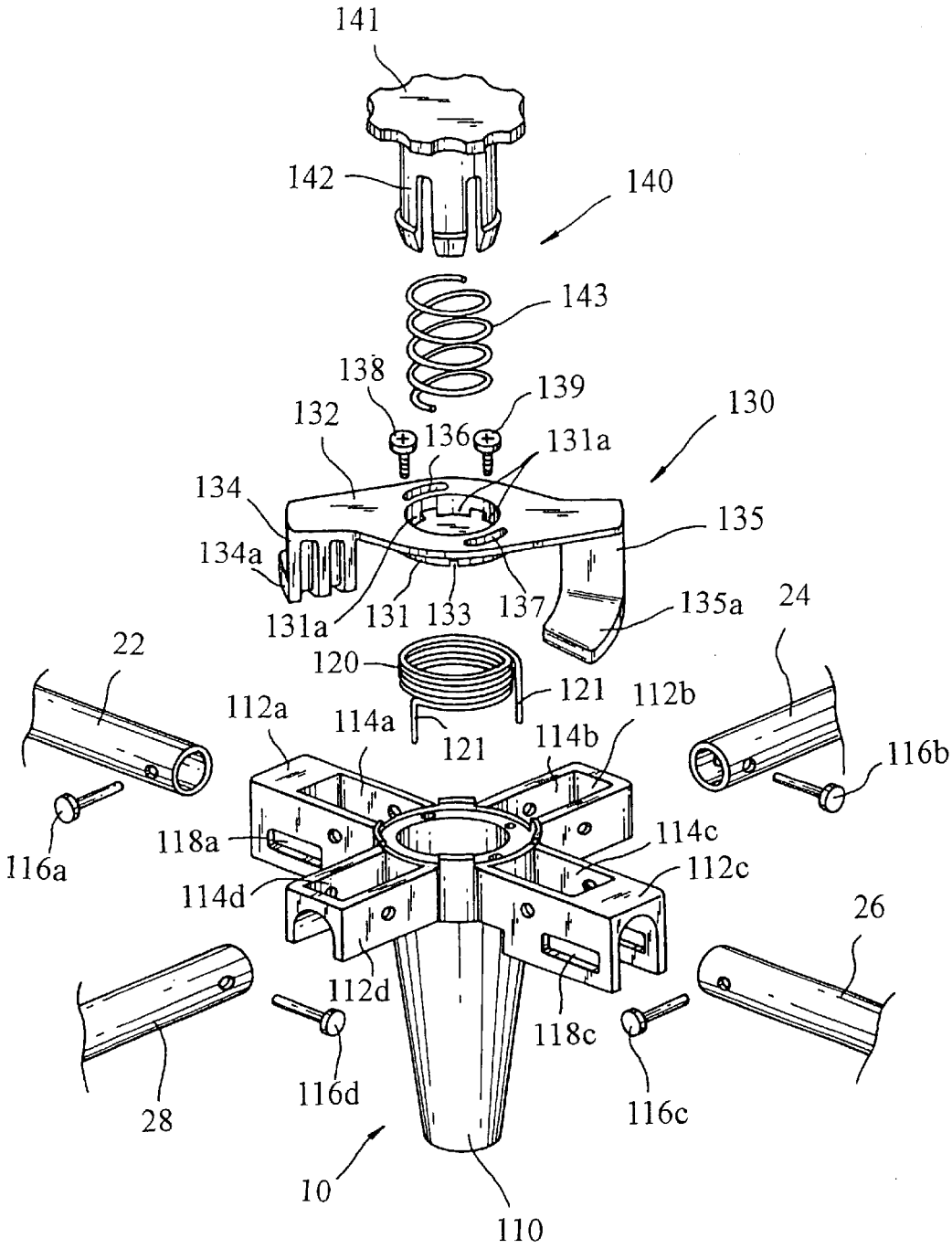
(Prior Art) FIG.11
FIG. 11 is an exploded perspective view illustrating a prior art hub assembly of lower frame of a foldable playyard.

While in use, tube legs 60 are lifted from a collapsed position (as shown in FIG. 9) and the open ends thereof will pivot about the pins 61 in a direction indicated by the arrows shown in FIG. 3. As illustrated in FIGS. 3 and 4, when tube legs 60 pivot to a position where the portions of the coupling pin 35 extending out the tube wall contact the inclined surfaces 18, 18' of the locking members, the coupling pin 35 will be pushed backward by the inclined surfaces 18, 18' as the tube legs 60 continue to pivot upward until the tube legs 60 reach a horizontal position where the coupling pin 35 no longer contacts with the inclined surfaces 18, 18'. While the tube legs are pivoted to this horizontal position, the slide 34 together with the coupling pin 35 will be pushed forward by the spring 32 to a locked position where the portions of the coupling pin 35 extending out the tube wall engage with the bottom faces 19, 19' of locking members (see FIG. 2) to thereby lock the tube legs 60 in an erected position, as shown in FIGS. 4 and 10. While at this locked position, at least one portion of the slide 34 extends into the cavity 14.

When need to unlock tube legs, the strap 40 is pulled upwardly to cause the actuating member 20 to move upward and the inclined surfaces 23, 24 are caused to contact with the inwardly slanted surface 36 of the slide 34. While the actuating member 20 continue moving upward, the slides 34 will be pushed further back into the tub legs 60 by the inclined surfaces 23, 24. This backward movement of the slide 34 will cause the coupling pin 35 to move backward as well and the tube legs 60 will be unlocked when the coupling pin 35 moves a distance that is greater than the length of the bottom faces 19, 19' of the locking members. While pulling the strap 40 further upward, the hub unit 1 and the entire lower frame of the playyard may be lift up by the actuating member 20 and the rivet 26, and then the unlocked tube legs 60 will pivot to the collapsed position because of their own weights, as shown in FIG. 9.

Referring now to FIGS. 5–8 to explain a hub unit 100 according to a second embodiment of the present invention.

The hub unit 100 according to the second embodiment of the present invention generally comprises a body 110 having a plurality of notches 112 formed at a periphery thereof for receiving tube legs 160 of the playyard; an actuating member 120 which is vertical movably coupled to the body 110; two sliding engaging assemblies 130 movably mounted to two oppositely positioned tube legs 160 respectively at an open end of the tube legs and the two opposite positioned tube legs 160 being rotatably received in two radially opposite notches 112 of the body respectively; and a strap 140 coupled to the actuating member 120.

Figure 5:
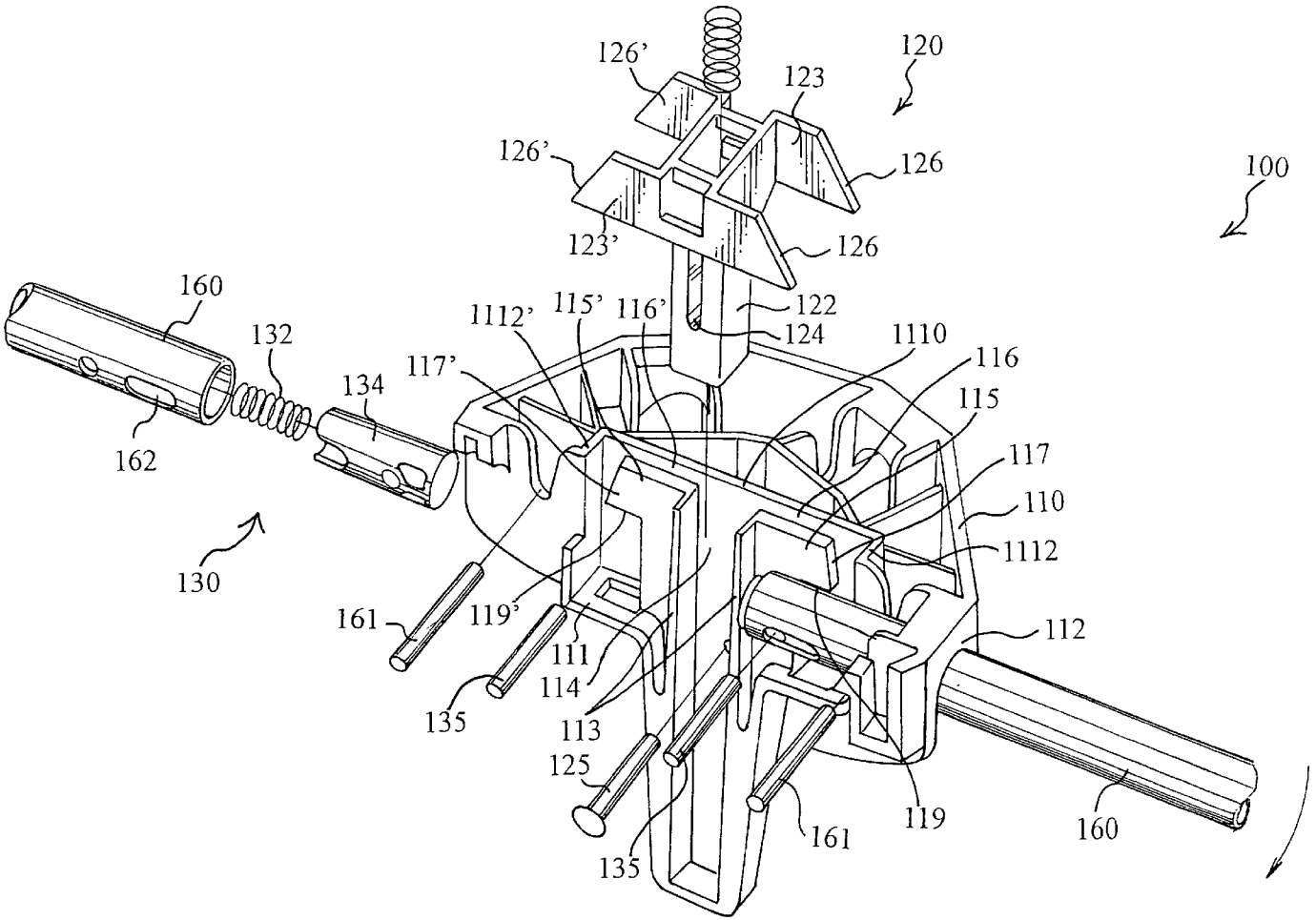
FIG. 5 is a partial sectional, exploded perspective view of the self-lock hub unit according to the second embodiment of the present application.
Figure 6:
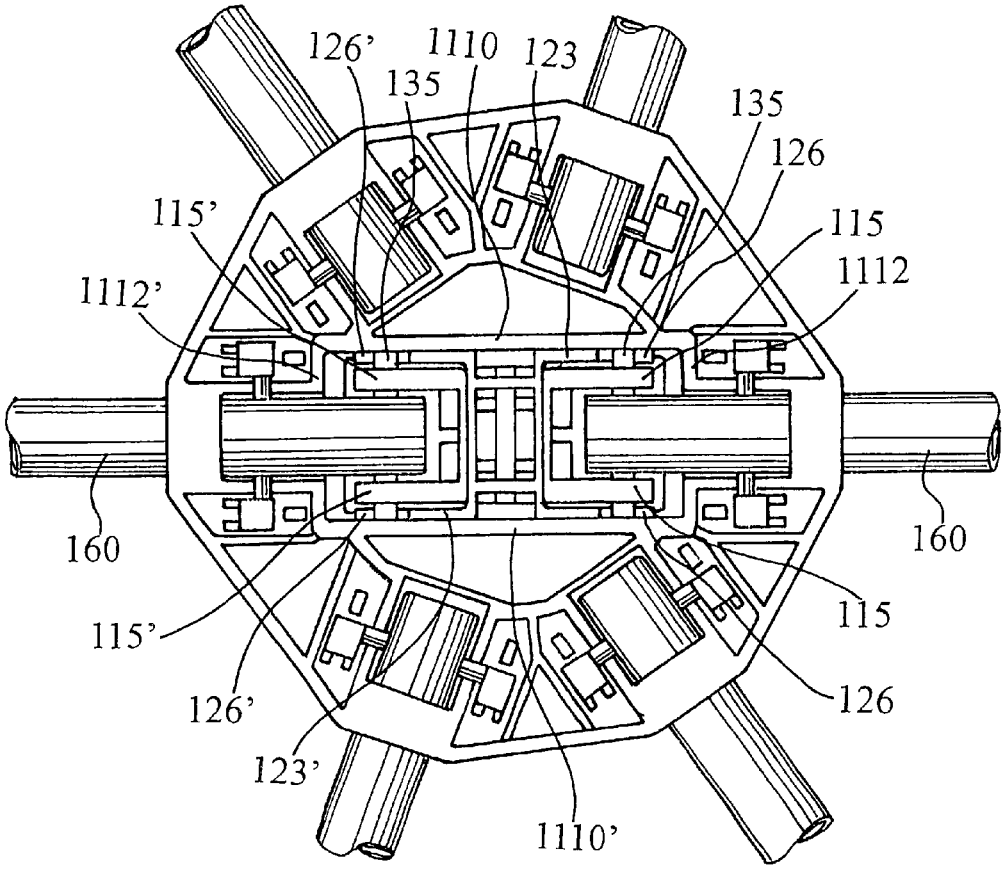
FIG. 6 is a top plan view of the self-lock hub unit shown in FIG. 5.

As shown in FIG. 5, the body 110 comprises a rectangular central recess 111 defined by two opposite long-side walls 1110, 1110' and two short-side walls 1112, 1112', wherein a notch 112 is formed at each of the short-side walls at a position corresponding to the oppositely positioned tube legs 160 for receiving an open end of the tub leg. The body 110 further comprises guiding plates 113, 113 disposed at the center portion of the recess 111 and arranged such that the guiding plates 113, 113 are spaced apart from each other so as to define a cavity 114 therebetween and are parallel with the short-side walls 1112, 1112'. Each of the guiding plates 113, 113 comprises a horizontal portion 115, 115' protruding outwardly from a top portion of sides at width direction. The horizontal portions 115, 115' are parallel with and spaced apart from the long-side wall 1110, 1110' of the recess 111, i.e., a space 116, 116' is defined between the horizontal portions 115, 115' and the long-side wall 1110, 1110' of the recess 111. The horizontal portions 115, 115' has a lower edge 119, 119' and an outwardly slanted face 117, 117' formed at a free end thereof.

The tube legs 160 are pivotally coupled to the notches 112 of the body through pins 161. Each of the tube legs 160 has two opposite elongated openings 162 formed in a tube wall thereof at a position adjacent to the open end of the tube leg. Each of the sliding engaging assemblies 130 includes a spring 132 disposed in the tube leg 160 through the open end and abutting the pin 161, a slide 134 disposed in the tube leg 160, and a coupling pin 135 extending through the elongated openings 162 and the slide 134 to slidably couple the slide 134 to the tube leg 160 with both ends of the coupling pin 35 extending out the tube wall a distance.

The actuating member 120 comprises an elongated stem portion 122 and two actuating plate 123, 123' transversally formed at a top of the stem portion 122. The stem portion 122 is sized and shaped so that it can be movably received in the cavity 114. Stem portion 122 has an elongated longitudinal opening 124 formed therein. The actuating member 120 is movably coupled to the body 110 by extending a rivet 125 through the opening 124 and fixing it to cavity walls. Actuating plate 123, 123' are formed at sides of the stem portion 122 facing the long-side walls 1110, 1110' respectively and arranged such that when the actuating member 120 is received in the cavity the actuating plates 123, 123' will be received in the space 116, 116'. An outwardly slanted face 126, 126' is formed at free ends of each of the actuating plates 123, 123'. The actuating member 120 further includes a return spring 127, which is retained in the opening 124 by fixing one end thereof to the rivet 125 and abutting the other end to the bottom of the opening 124.

Figure 7:
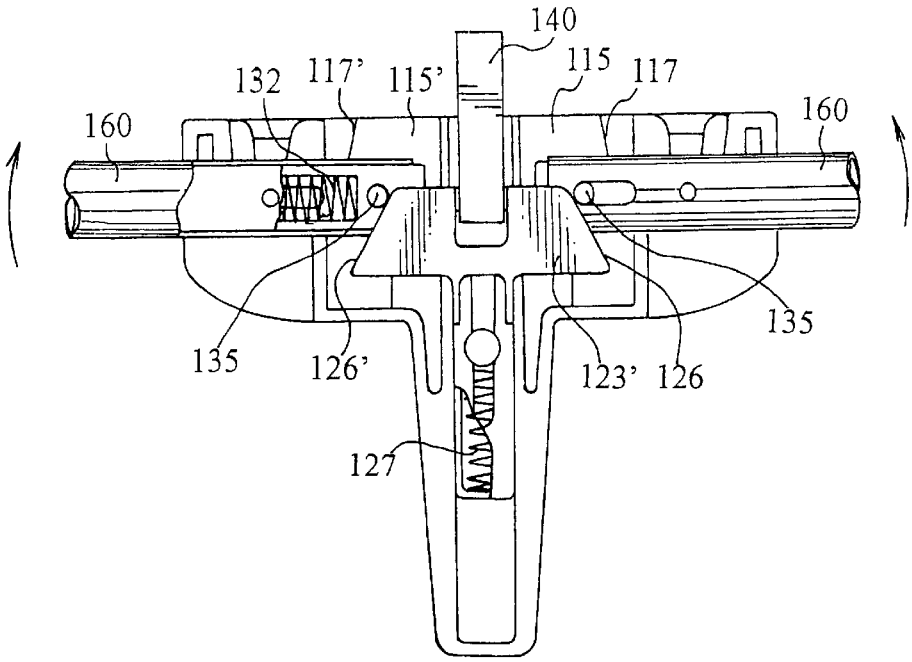
FIG. 7 is a cross-section view of the self-lock hub unit shown in FIG. 5, which illustrates the tube legs are in a locked state.
Figure 8:
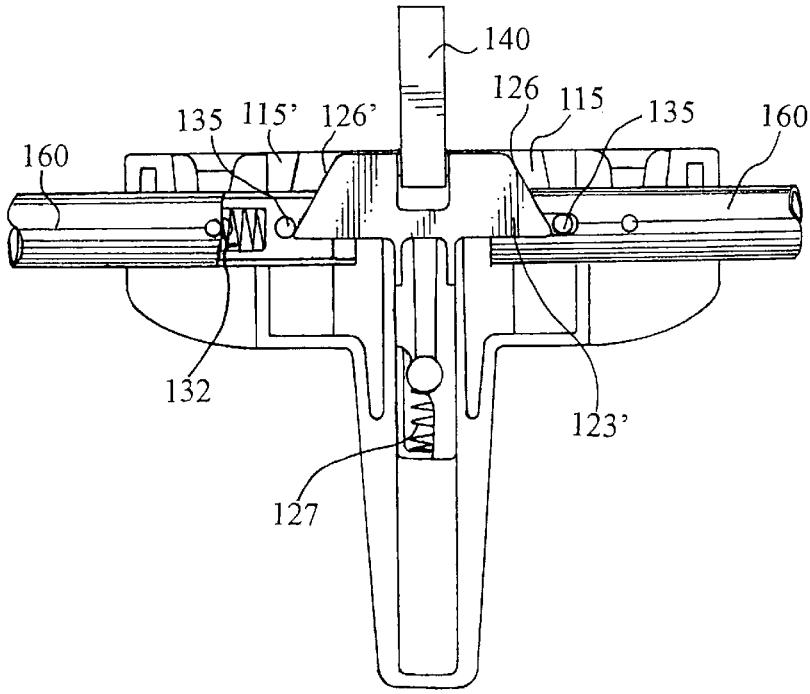
FIG. 8 is a cross-section view of the self-lock hub unit shown in FIG. 5, which illustrates the tube legs are in an un-locked state.

While in use, tube legs 160 are lifted from a collapsed position (as shown in FIG. 9) and the open ends thereof will pivot about the pins 161 in a direction indicated by the arrows shown in FIG. 7. When tube legs 160 pivot to a position where the portions of the coupling pin 135 extending out the tube wall contact the inclined surfaces 117, 117' of the horizontal portion 115, 115' the coupling pin 35 will be pushed backward by the inclined surfaces 117, 117' as the tube legs 160 continue to pivot upward until the tube legs 160 reach a horizontal position where the coupling pin 135 no longer contacts with the inclined surfaces 117, 117'. While the tube legs 160 are pivoted to this horizontal position, the slide 134 together with the coupling pin 35 will be pushed forward by the spring 132 to a locked position where the portions of the coupling pin 135 extending out the tube wall engage with the lower edge 119, 119' of horizontal portion 115, 115' (see FIG. 7) to thereby lock the tube legs 160 in a erected position, as shown in FIGS. 7 and 10. While at this position, the actuating member 120 is retained at the bottom of the cavity 114 because of the spring force exerted by the return spring 127.

When need to unlock tube legs, the actuating member 120 is caused to move upward by upwardly pulling the strap 140 and the outwardly slanted faces 126, 126' of the actuating plates 123, 123' are caused to contact with the portions of the coupling pin 135 extending out the tube wall. While the actuating member 120 continues to move upward, the portions of the coupling pin 135 engaging with the lower edge 119, 119' of horizontal portion 115, 115' will be pushed further back into the tub legs 160 by the outwardly slanted faces 126, 126'. This backward movement of the coupling pin 135 will cause the tube legs 160 to be unlocked when the coupling pin 135 moves a distance that is greater than the length of the lower edge 119, 119' of horizontal portion 115, 115'. While pulling the strap 140 further upward, the hub unit 100 and the entire lower frame of the playyard may be lift up by the actuating member 120 and the rivet 125, and then the unlocked tube legs 160 will pivot to the collapsed position as shown in FIG. 9.

This invention has been disclosed in terms of specific embodiments. It will be apparent for people skilled in this art that many modifications can be made to the disclosed structures without departing from the invention. Therefore, it is the intent of the appended claims to cover all such variations and modifications as come within the true spirit and scope of this invention.

What is claimed is:

1. A self-lock hub unit of a lower frame of a playyard comprising:

a body having a plurality of slots formed at a periphery thereof for receiving tube legs of the playyard and a vertical cavity formed at the center thereof;

an actuating member which is vertically movably received in the vertical cavity;

two sliding engaging assemblies movably mounted to two oppositely positioned tube legs respectively, each sliding engaging assembly having a first member, a second member coupled to the first member for movably coupling the first member to one of the tube legs, and a biasing member disposed in the tube leg to bias the first and second members toward an open end of the tube leg, wherein the two oppositely positioned tube legs are rotatably received in two radially opposite slots of the body respectively;

two locking means formed on the body at positions corresponding to the sliding engaging assemblies respectively and having a guiding portion and an engaging portion; and a strap coupled to the actuating member;

wherein the actuating member, the sliding engaging assemblies, and locking means are arranged such that while the tube legs are rotated from vertical position to horizontal position, the second member of the sliding engaging assembly will contact with and guided by the guiding portion of the locking means to engage with the engaging portion of the locking means and thereby locking the tube legs in horizontal position with at least one portion of the first member of the sliding engaging assembly protruding into the central cavity; and while the actuating member is moved upward by pulling the strap, the actuating member will engage with the at least one portion of the first member that protruding into the cavity and push the first member to cause the second member disengaging with the engaging portion of the locking means.

2. A self-lock hub unit of a lower frame of a playyard as claimed in claim 1, wherein the actuating member comprises a head portion, a stem portion coupled to the head portion, a longitudinal opening formed in the stem portion, and a rivet extending through the opening and fixed to the body to thereby movably fixing the actuating member in the cavity.

3. A self-lock hub unit of a lower frame of a playyard as claimed in claim 2, wherein the actuating member further comprises a spring fixedly retained between a bottom of the opening and the rivet.

4. A self-lock hub unit of a lower frame of a playyard as claimed in claim 2, wherein the head portion includes a left inclined plane and a right inclined plane and each respectively slanted downwardly and outwardly from the head portion so that the head portion is formed as an arrow shape.

5. A self-lock hub unit of a lower frame of a playyard as claimed in claim 1, wherein the biasing member of the sliding engaging assembly is a spring disposed in the open end of the tube leg; the first member is a slide which is disposed in the open end of the tube leg and abut the spring; and the second member is a coupling pin which extends through the slide and the openings of the tube wall to thereby slidably coupling the slide to the tube leg, wherein both ends of the coupling pin extend out of the tube wall a distance and the slide is biased by the spring and protrudes out the open end a distance.

6. A self-lock hub unit of a lower frame of a playyard as claimed in claim 5, wherein the slide has an inwardly slanted face formed at the end protruding out the open end of the tube leg.

7. A self-lock hub unit of a lower frame of a playyard as claimed in claim 5, wherein each of the locking means comprises two locking members are arranged such that the locking members are spaced apart from each other a distance and the distance is sized to be larger than an outer diameter of the tube leg to allow the open end of the tube leg and the portion of the slide that protruding out the tube leg can pass therethrough.

8. A self-lock hub unit of a lower frame of a playyard as claimed in claim 7, wherein each of the locking members is shaped as a reversed 'L' and has a vertical portion and a horizontal portion, wherein the horizontal portion has a lower face and an outwardly slanted face formed at a free end thereof.

9. A self-lock hub unit of a lower frame of a playyard as claimed in claim 8, wherein the guiding portion of the locking means is the outwardly slanted face of the horizontal portion, and the engaging portion is the lower face of the horizontal portion.

10. A self-lock hub unit of a lower frame of a playyard comprising:

a body having a plurality of notches formed at a periphery thereof for receiving tube legs of the playyard and a rectangular recess formed at the center portion and defined by two opposite long-side walls and two short-side walls;

two guiding plates disposed at the central portion of the recess and parallel with the short-side walls, the guiding plates being arranged such that they are spaced apart from each other so as to define a cavity therebetween;

an actuating member which is movably received in the cavity;

two sliding engaging assemblies movably mounted to two oppositely positioned tube legs respectively, each sliding engaging assembly having a first member, a second member coupled to the first member for movably coupling the first member to one of the tube legs, and a biasing member disposed in the tube leg to bias the first and second members toward an open end of the tube leg, wherein the two oppositely positioned tube legs are rotatably received in two radially opposite notches of the body respectively;

two locking means formed on the body at positions corresponding to the sliding engaging assemblies respectively and having a guiding portion and an engaging portion; and a strap coupled to the actuating member, wherein the actuating member, the sliding engaging assemblies, and locking means are arranged such that while the tube legs are pivoted from a vertical position to a horizontal position, the second member of the sliding engaging assembly will contact with and guided by the guiding portion of the locking means to engage with the engaging portion of the locking means and thereby locking the tube legs in an erected position; and while the actuating member is moved upward by pulling the strap, the actuating member will push the second member to disengage with the engaging portion of the locking means.

11. A self-lock hub unit of a lower frame of a playyard as claimed in claim 10, wherein a notch is formed at each of the short-side walls at a position corresponding to one of the oppositely positioned tube legs for receiving an open end of the tub leg.

12. A self-lock hub unit of a lower frame of a playyard as claimed in claim 10, wherein the locking means are horizontal portions protruding outwardly from a top portion of sides at width direction of each of the guiding plates, the horizontal portions are parallel with and spaced apart from the long-side walls of the central recess with a space defined therebetween, and have a lower edge and an outwardly slanted face formed at a free end thereof.

13. A self-lock hub unit of a lower frame of a playyard as claimed in claim 12, wherein the guiding portion of the locking means is the outwardly slanted face of the horizontal portion of the guiding plate, and the engaging portion of the locking means is the lower edge of the horizontal portion of the guiding plate.

14. A self-lock hub unit of a lower frame of a playyard as claimed in claim 10, wherein the biasing member of the sliding engaging assembly is a spring disposed in the open end of the tube leg; the first member is a slide which is disposed in the open end of the tube leg and abut the spring; and the second member is a coupling pin which extends through the slide and the openings of the tube wall to thereby slidably coupling the slide to the tube leg, wherein both ends of the coupling pin extend out of the tube wall a distance.

15. A self-lock hub unit of a lower frame of a playyard as claimed in claim 12, wherein the actuating member comprises an elongated stem portion and two actuating plates transversally formed at sides of the stem portion facing the long-side walls respectively and arranged such that when the actuating member is received in the cavity, the actuating plates will be received in the spaces between the horizontal portions of the guiding plates and the long-side walls.

16. A self-lock hub unit of a lower frame of a playyard as claimed in claim 15, wherein the stem portion is sized and shaped to be movably received in the cavity, and has an elongated longitudinal opening formed therein, whereby the actuating member may be movably retained in the cavity by a rivet which extends through the elongated opening of the stem portion and fixed to the body.

17. A self-lock hub unit of a lower frame of a playyard as claimed in claim 15, wherein an outwardly slanted face is formed at both ends of each of the actuating plates.

18. A self-lock hub unit of a lower frame of a playyard as claimed in claim 15, wherein the actuating member further comprising a return spring disposed in the elongated opening of the stem portion at a position between the rivet and a bottom of the opening.

* * * * *